US007032352B2

(12) United States Patent
Zebuhr

(10) Patent No.: US 7,032,352 B2
(45) Date of Patent: Apr. 25, 2006

(54) STRUCTURE TO LIMIT DAMAGE DUE TO FAILURE

(76) Inventor: William H. Zebuhr, 6 Southgate Dr., Nashua, NH (US) 03062

( * ) Notice: Subject to any disclaimer, the term of this patent is extended or adjusted under 35 U.S.C. 154(b) by 271 days.

(21) Appl. No.: 10/208,952

(22) Filed: Jul. 31, 2002

(65) Prior Publication Data

US 2004/0020146 A1 Feb. 5, 2004

(51) Int. Cl.
*E04B 7/16* (2006.01)

(52) U.S. Cl. ..... 52/64; 52/236.3; 52/167.1

(58) Field of Classification Search ..... 52/121, 52/120, 79.1, 79.5, 632, 234, 236.3, 236.6, 52/167.1, 263; 212/231, 264, 296; 187/289
See application file for complete search history.

(56) References Cited

U.S. PATENT DOCUMENTS 2,740,504 A * 4/1956 Bailey ..... 52/121
3,213,574 A * 10/1965 Melbye et al. ..... 52/121
3,248,831 A * 5/1966 Jones ..... 52/121
3,328,921 A * 7/1967 Keslin ..... 52/121
3,495,370 A * 2/1970 Habro et al. ..... 52/632
3,738,786 A * 6/1973 Van Buren ..... 425/111
4,357,785 A * 11/1982 Eklund ..... 52/632
4,452,431 A * 6/1984 Stephens et al. ..... 256/13.1
4,478,014 A * 10/1984 Poock et al. ..... 52/115
4,844,213 A * 7/1989 Travis ..... 188/377
5,052,645 A * 10/1991 Hixon ..... 248/125.2
5,101,215 A * 3/1992 Creaser, Jr. ..... 343/883
5,112,028 A * 5/1992 Laturner ..... 256/13.1
5,192,157 A * 3/1993 Laturner ..... 404/6
5,218,375 A * 6/1993 Hillman ..... 343/883
5,228,251 A * 7/1993 Frigon ..... 52/111
5,271,197 A * 12/1993 Uno et al. ..... 52/167.1
5,381,633 A * 1/1995 Hendrich ..... 52/71
5,491,938 A * 2/1996 Niwa et al. ..... 52/167.1
5,502,932 A * 4/1996 Lu ..... 52/167.9
5,537,125 A * 7/1996 Harrell et al. ..... 343/878
5,615,855 A * 4/1997 Marue et al. ..... 248/405
D392,397 S * 3/1998 Werber ..... D25/126
5,727,663 A * 3/1998 Taylor ..... 188/378
5,740,652 A * 4/1998 Inoue et al. ..... 52/745.1
5,765,316 A * 6/1998 Kavarsky ..... 52/67
5,786,854 A * 7/1998 Slade et al. ..... 348/373
5,946,880 A * 9/1999 Morrison, III et al. .... 52/737.1
5,957,435 A * 9/1999 Bronstad ..... 256/13.1
6,046,706 A * 4/2000 Vargas ..... 343/883
6,155,017 A * 12/2000 Turner ..... 52/726.4
6,397,528 B1 * 6/2002 Rahimian ..... 52/167.1
6,499,612 B1 * 12/2002 Harrgington et al. ..... 212/350
6,651,394 B1 * 11/2003 Hughes ..... 52/167.1
6,701,680 B1 * 3/2004 Fanucci et al. ..... 52/167.3

* cited by examiner

*Primary Examiner*—Naoko Slack
(74) *Attorney, Agent, or Firm*—Foley Hoag LLP

(57) ABSTRACT

A tall building (100) includes a plurality of ray structures (104, 106) extending outward from a central, generally conical hollow reinforced-concrete core (102). In three of the rays (104), a frame (118) extends diagonally downward and outward from the core. If a building floor located above the barrier falls onto the floors extending outward from the barrier, the latter floors will fail in such a manner as to cover the barrier frame and shed all floors that fall onto the resultant barrier from above it. A chain-reaction failure caused by failed floors falling on successively lower floors is thereby interrupted, and floors below the barrier are protected from damage by floors that have fallen from above the barrier.

12 Claims, 7 Drawing Sheets

STRUCTURE TO LIMIT DAMAGE DUE TO FAILURE

BACKGROUND OF THE INVENTION

1. Field of the Invention

This invention relates to structures, in particular tall buildings. It is a way of constructing a tall structure such that failure of part of the structure that results in a collapse above the failure does not cause a total collapse of the structure.

2. Background Information

Tall buildings have a strong generally vertical structure designed to resist the force of gravity and generally diagonal and horizontal struts working in concert with the weight-carrying structure to resist side loads due to wind, earthquakes impact etc. Within this framework floors must be supported if the structure is a multi-floored building. Any given piece of the structure can perform multiple functions, depending on the particular design. If a failure of a member occurs loads are transferred to other members and no overall failure occurs if these are not over loaded to the point of failure. Total failure of the structure can occur however if the overloaded members fail and the process continues. This is what happens in a tall building if upper floors and related structure collapse into the floors and structure below. Increasing overload occurs and the total structure collapses virtually completely.

In a conventional structure the floors are attached to the vertical supports and each floor has a factor of safety for unexpected high loads. However, it simply is not practical to have each floor so strong that it can with stand the impact of floors and other structure falling from above.

The collapse of the World Trade Center on Sep. 11, 2001, sadly shows the potential result of a failure in a conventionally constructed building. The intent of this invention is to greatly reduce such a possibility in future large, tall structures.

SUMMARY OF THE INVENTION

The likelihood of catastrophic failure can be greatly reduced by using one or both of two concepts that the drawings exemplify. The first is to provide an interior barrier disposed above some of the building's floors and below others and inclined at an angle of at least 30°. The barrier is so constructed and supported that it can withstand the load of an upper floor that has fallen on it, and the barrier's inclination will tend to shed the fallen floor so that, in falling further, it does not fall on floors below the barrier. A barrier of this type can thus interrupt a cascade failure and thereby isolate major failures.

The second concept is for the tall building to be constructed around a reinforced concrete core that extends the height of the building or possibly higher or not quite as high. The interior core could be almost any shape e.g. a cylinder, tetrahedron, tall pyramid etc but a cone is inherently the most secure because it is all in compression. It round section makes it very resistant to pressure such as from an explosion and it taper fits well with the structural and utility requirements of a tall structure.

The cone could be fairly economically constructed by standard techniques but it would not make a good exterior wall because to serve the demanding structural and protective requirements it would have few openings, therefore few windows. Also its shape is not ideal for having reasonable floor areas at upper levels. Therefore it is best to use it for an interior core and primary support and surround it with the building which could be conventionally constructed but preferably constructed according to this invention if it is a tall structure.

Preferably, the major volume of the building would be exterior to the cone and would have normal functionality with useful floor plans, windows, utilities, etc. The core volume would be inside the cone and contain the elevators, emergency stairs, main utility lines and fire protection equipment. The elevators would preferably not pass through the steep sides of the cone creating vulnerability but remain inside with horizontal passages or doorway through the cone. Thus openings would be minimized and the cone would serve as a safe haven for the building occupants in case of emergency including failure of part of the structure outside of the cone. The cone would serve as the interior support of the entire structure and would be capable of taking all or a large part of the lateral loading. The exterior structure would carry part of its own weight, maybe most of it, and might add to lateral stability but it would collapse partially or totally from the cone without collapsing the cone. Thus general radial structures could be built around the cone and each could be structurally independent from the other and any one could totally fail without adversely effecting the rest. In an impending crisis occupants from any of the radial structures could enter the cone for safety.

A building employing both concepts would be safe against total collapse by two modes. One is that any particular vertical section would be able to shed a failed structure from above and the second is that the lateral separation afforded by the cone restricts this to one vertical section out of several and even a total collapse of one vertical section would leave the cone and other vertical sections intact. The other major feature is that any habitable section would have fast basically horizontal access to the secure interior of the cone and the building services would have a good chance of continuing to function including elevators.

BRIEF DESCRIPTION OF THE DRAWINGS

The invention description below refers to the accompanying drawings, of which.

DETAILED DESCRIPTION OF AN ILLUSTRATIVE EMBODIMENT

Figure 1:
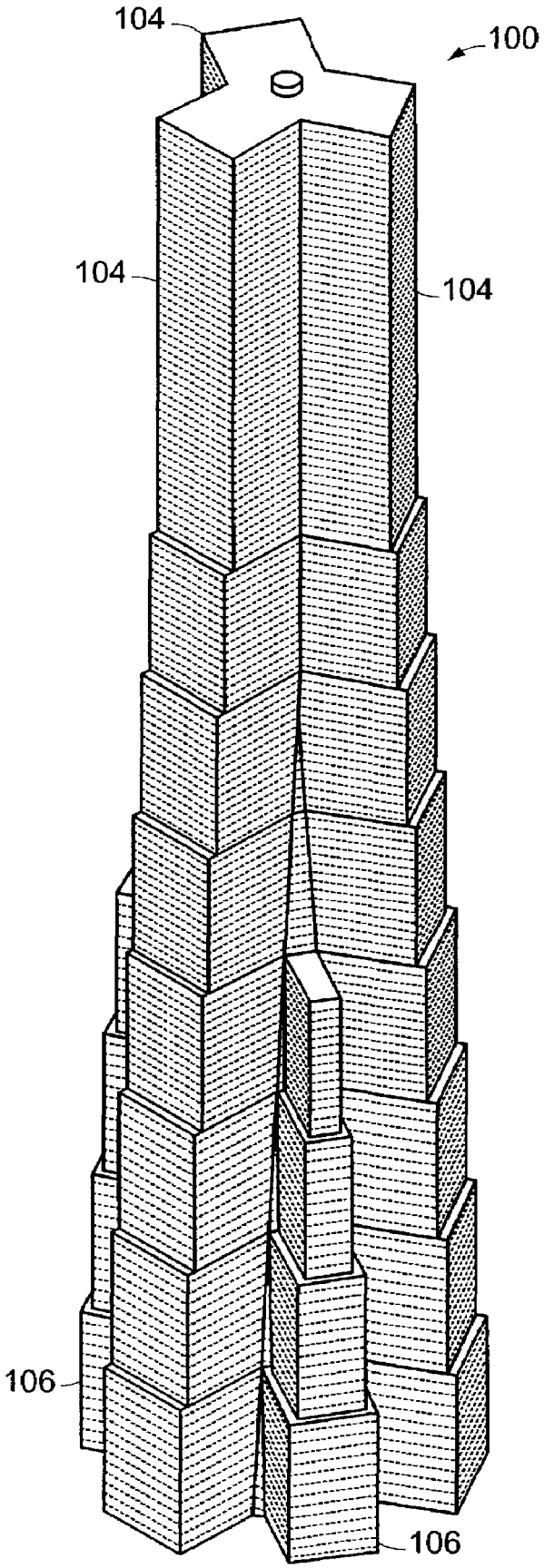
FIG. 1 is an isometric overview of a large building utilizing the features of the invention.
Figure 2:
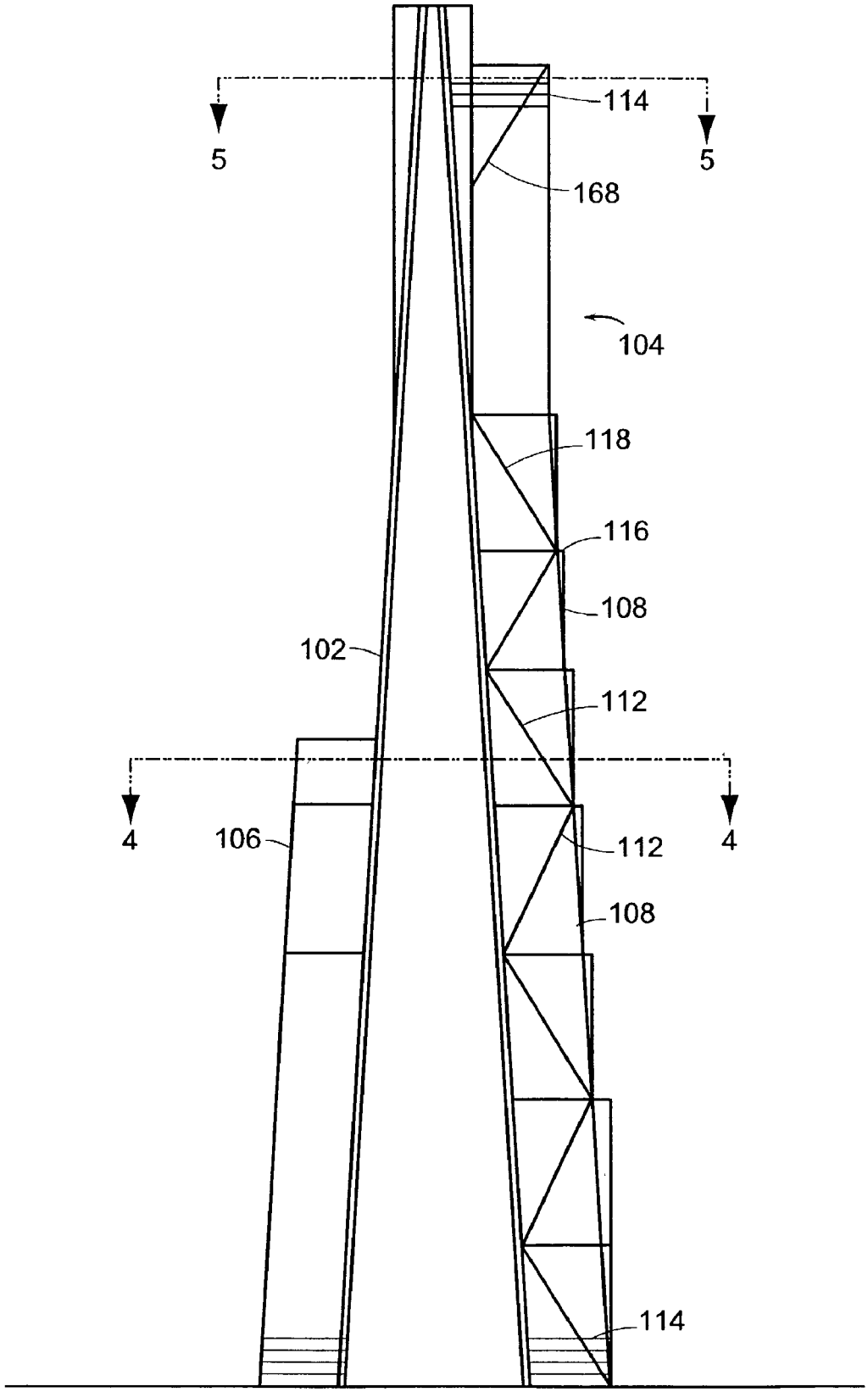
FIG. 2 is a cross-section elevation through the centerline of the building of FIG. 1.

FIG. 1 is an illustration of a tall building 100 constructed in accordance with this invention. FIG. 2 shows a section showing a conical core 102 and some framework of two attached structures, which will be referred to as "rays," that radiate from the central axis. As FIG. 1 shows, three rays 104 extend full height, and three rays 106 extend part way up.

Figure 3:
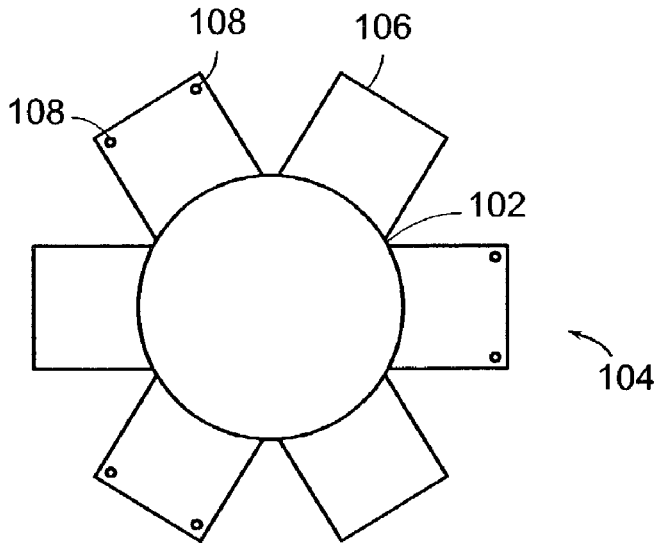
FIG. 3 is a plan view of the building base.
Figure 5:
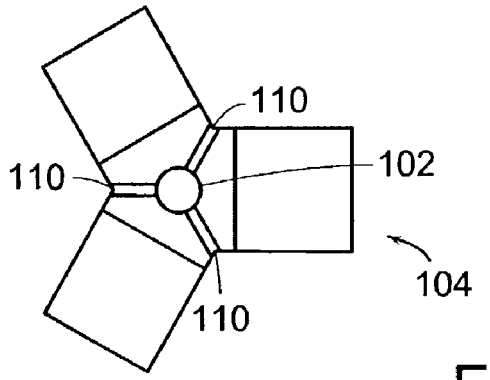
FIG. 5 is a cross-sectional plan view taken at lines 5—5 of FIG. 2.

FIG. 3 is a plan view at the ground level showing columns 108. The primary-weight bearing structures holding up rays 104 are the core 102 on the inside and columns 108 on the outside. Two columns roughly in the outer corners are shown for simplicity, but more could, and very likely would, be used. FIG. 5 shows core 102 having walls 110 extending radially from the core 102, dividing the rays, and cooperating with the core to provide support as the cone alone does at lower levels.

Although the building's core can be any of a variety of hollow structures, a cone such as core 102 is preferable because it is balanced, is all in compression, and has a natural taper that is compatible with a tall structure both for load carrying and to house elevators and other services that require more area at lower levels. Preferably, the taper is such that in cross section the core wall forms an angle of between 1° and 10° with the vertical. The preferred material for the core is reinforced concrete. In building 100, the core might be 250 feet in diameter at the base with walls 6 feet thick or more, and taper to 50 feet in diameter at the top with walls 4 feet thick. These are just example dimensions, but the core's thickness should be at least 2% of its diameter throughout a majority of its height. Openings in the core would be kept small and as few as practical to preserve structural integrity and prevent entry of any large item that might be a threat, e.g., motor vehicles and airplanes. The total area of the openings should be less then 10%, and preferably less than 5% of the total cone exterior area. Such a structure, 1900 feet height in the present example, would weigh several hundred thousand tons and be extremely resistant to penetration or destruction by outside forces. It is also a shape that is pressure resistant and therefore can survive a strong explosion.

The core in the present example, even though massive, is a cost-effective solution because it can be straightforwardly constructed from known materials (reinforced concrete) and serves as a major support and provides a sanctuary available from every floor, if desired, where occupants would be safe from fire, explosion, impact, or even collapse of one of the ray structures. A building of this size would have multiple sensors to forewarn of impending danger in many cases. An occupant would never be more than about 120 feet from the sanctuary, which is preferably accessible from each ray on each floor. Services such as elevators, stairs, and medical equipment would be protected in the core.

Figure 4:
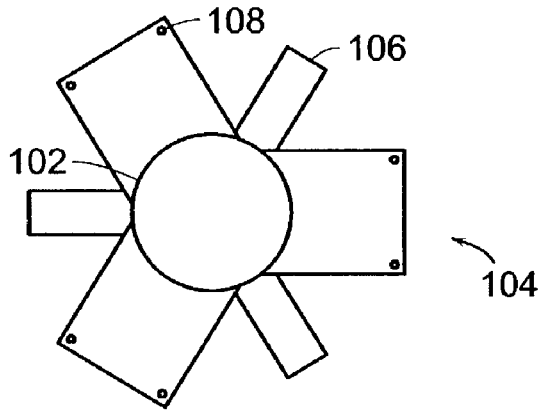
FIG. 4 is a cross-sectional view taken at lines 4—4 of FIG. 2.

One of the features of the core is that it be self-supporting. It can be constructed first and used to assist in the rest of the construction. The ray structures would be preferably symmetrical about the center and would add to the structural integrity of the whole structure. The load-bearing columns 108 (FIGS. 3 and 4) in combination with diagonal braces 112 (FIG. 6) add bending stiffness to the overall structure.

Core 102 is massive and self-supporting, while rays 104 and 106 are independent substructures unified by and approximately half-supported by core 102. Any given ray can collapse without causing collapse of any other or the core. The core is a massive structure and all the attachment points between the ray structures and the core are preferably small enough by comparison that they can be overstressed to failure in any direction without significantly impacting the core. The rays are not attached to each other except, at most, by structures that are light and fragile compared to the main supports of the ray or compared to the core. This assures that if any ray collapsed the act of pulling away from the core or any other ray would have only minor impact on the core or adjacent ray. The collapse of a ray 104, as terrible as it would be would be, would at least not take the rest of the building with it and would allow core 102 to stay intact and serve as a readily available sanctuary.

Figure 6:
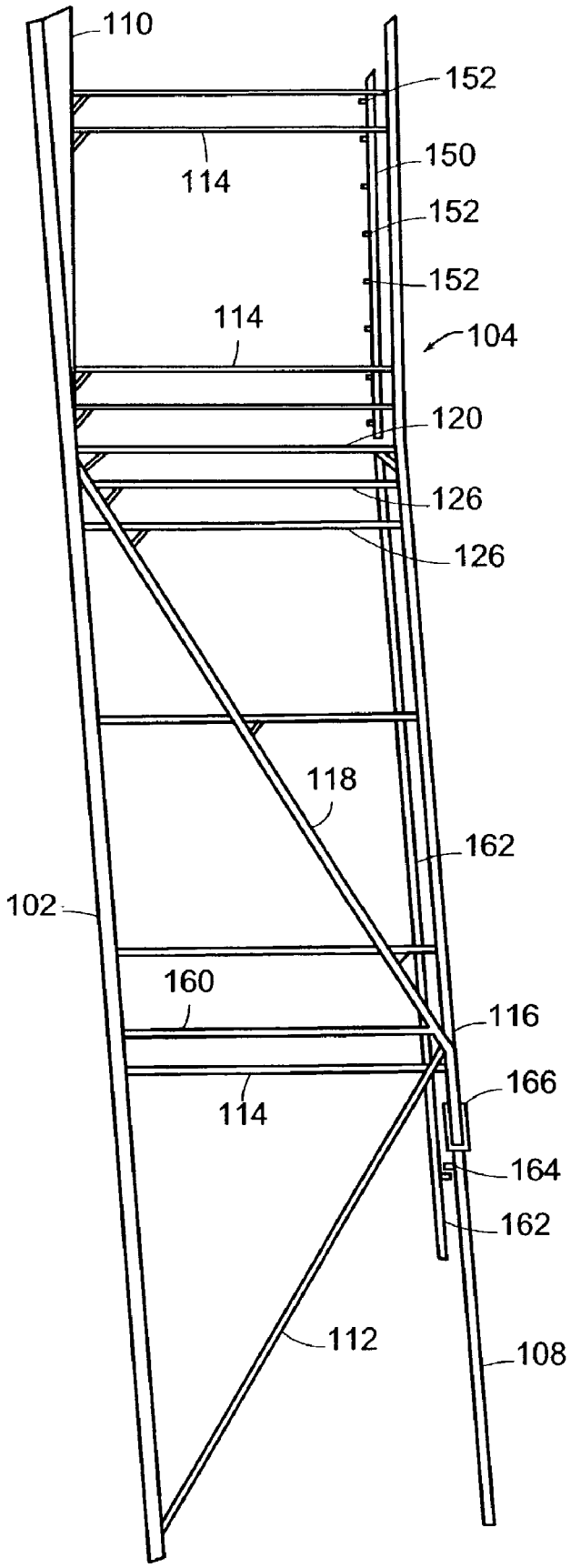
FIG. 6 is cross-sectional elevation view of some critical structural elements of a section of the building of FIG. 1.
Figure 7:
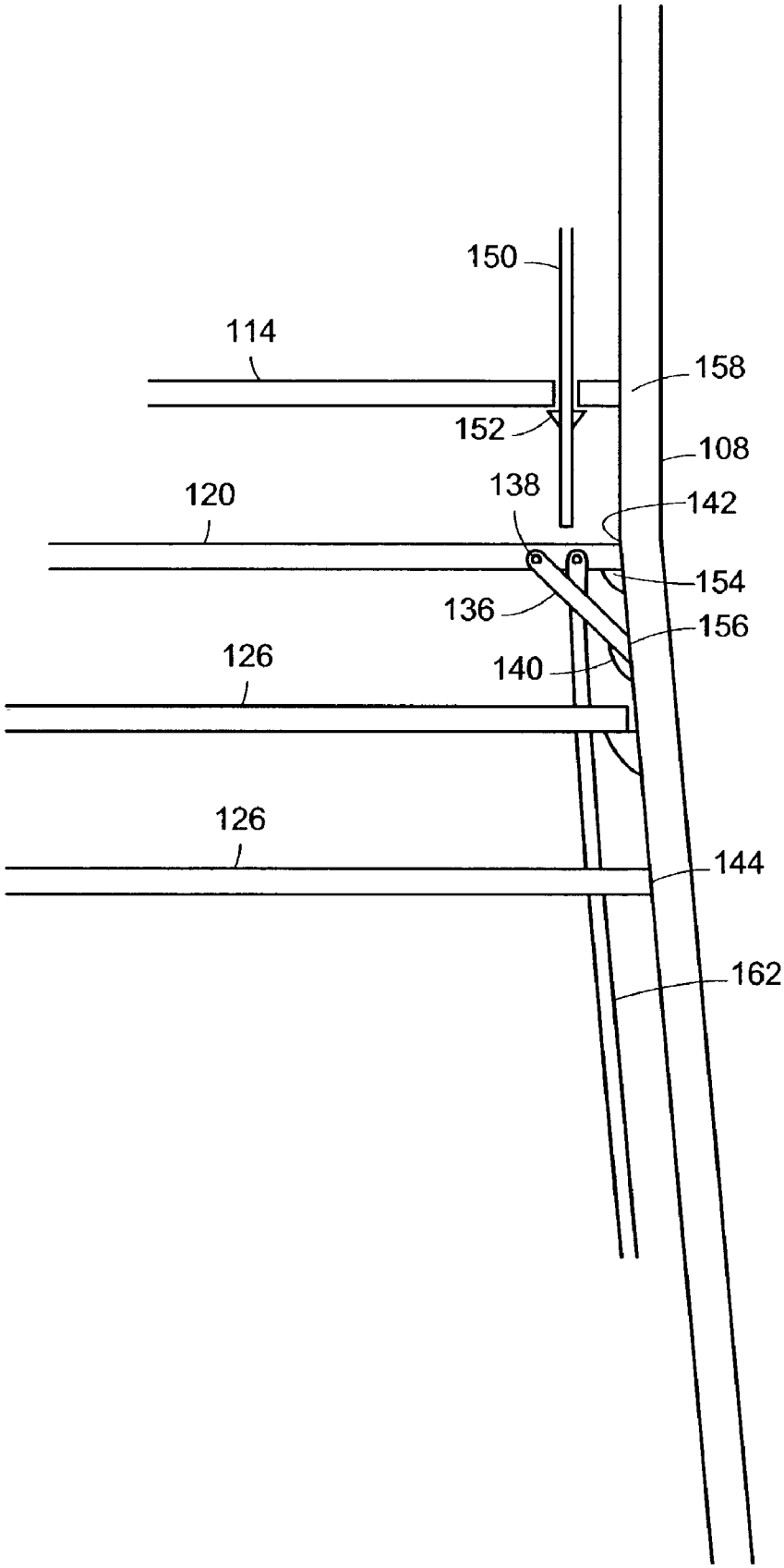
FIG. 7 is a close up of details of FIG. 6.
Figure 8:
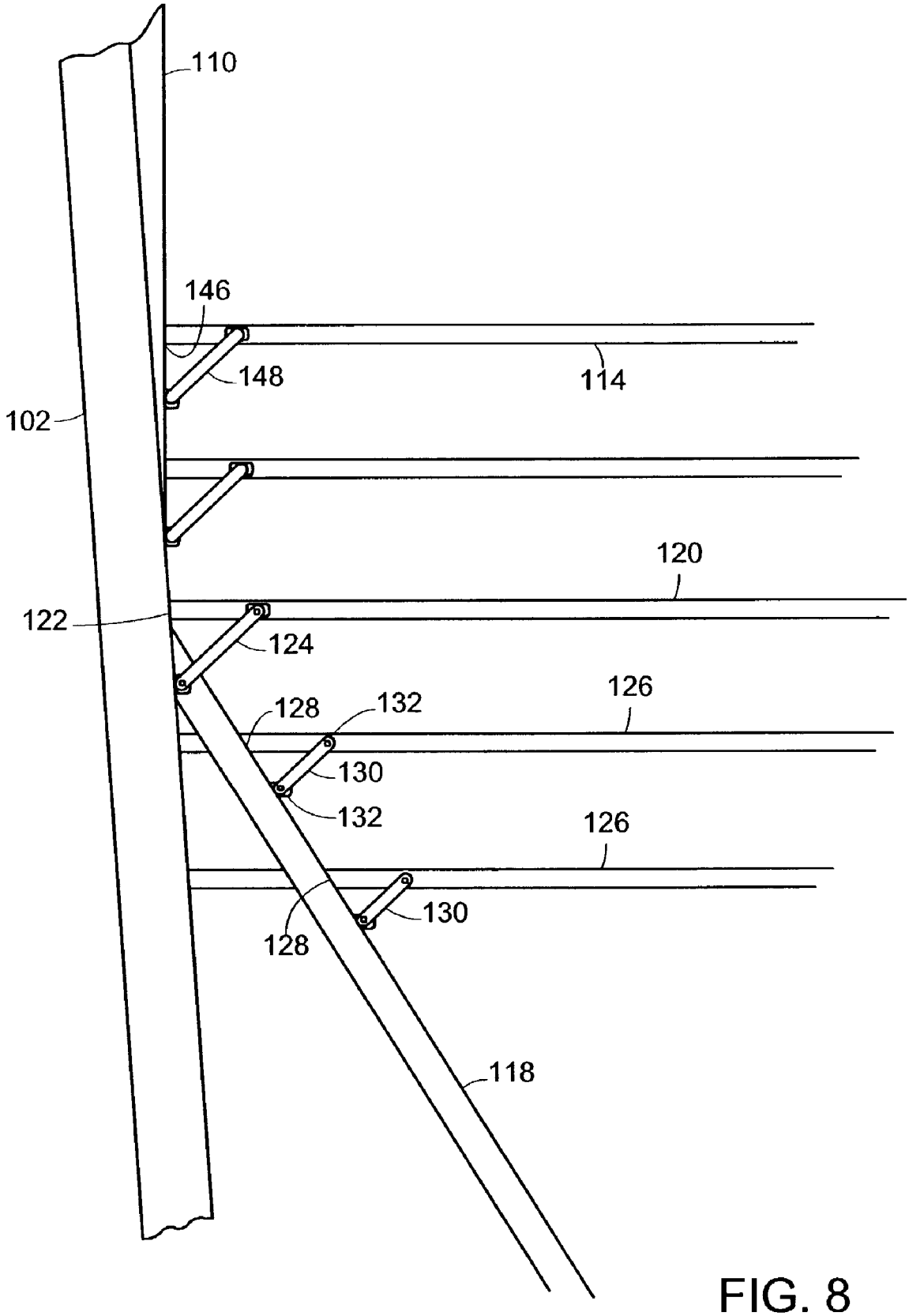
FIG. 8 is another close up of details of FIG. 6.

As will now be explained, though, an aspect of the invention makes the complete collapse of a ray 104 highly unlikely because it tends to prevent a partial collapse from continuing down the vertical height of the structure. To appreciate this feature, consider FIG. 2, which shows major frame elements of ray 104. Columns 108 and diagonals 112 along with core 102 are the major support of the structure including all floors 114 and their contents. The structure below point 116 can be considered basically a conventional structure, but above 116 it is designed not only to provide all the functions of a conventional structure but to also be able to fail structurally in a way that does not start a cascading event that takes the entire ray 104 with it. FIGS. 6, 7 and 8 show the components of this structure.

Steeply sloped frame members collectively form barrier 118, as FIGS. 2 and 6 illustrate. Barrier 118 is supported by columns 108 at its lower end and core 102 at its upper end. Barrier 118 extends the full width of the ray 104 and contains at least two coplanar frame members but preferably five or more for the example shown. As constructed, barrier 118 is an open framework. If the ray 104 is so severely damaged above point 116 that it begins to collapse, though, a specially constructed floor 120 called the "critical floor" will break away from core 102 at point 122 (FIG. 8) and hinge via links 124 to fold down on barrier 118. Partial floors 126, shown in FIG. 8 below the critical floor 120, will similarly hinge down by breaking away at points 128 and hinging on links 130. These floors will form a shingled cover over barrier 118 making it a solid sloped roof-like barrier over the structure below it, as FIG. 9 illustrates.

Figure 9:
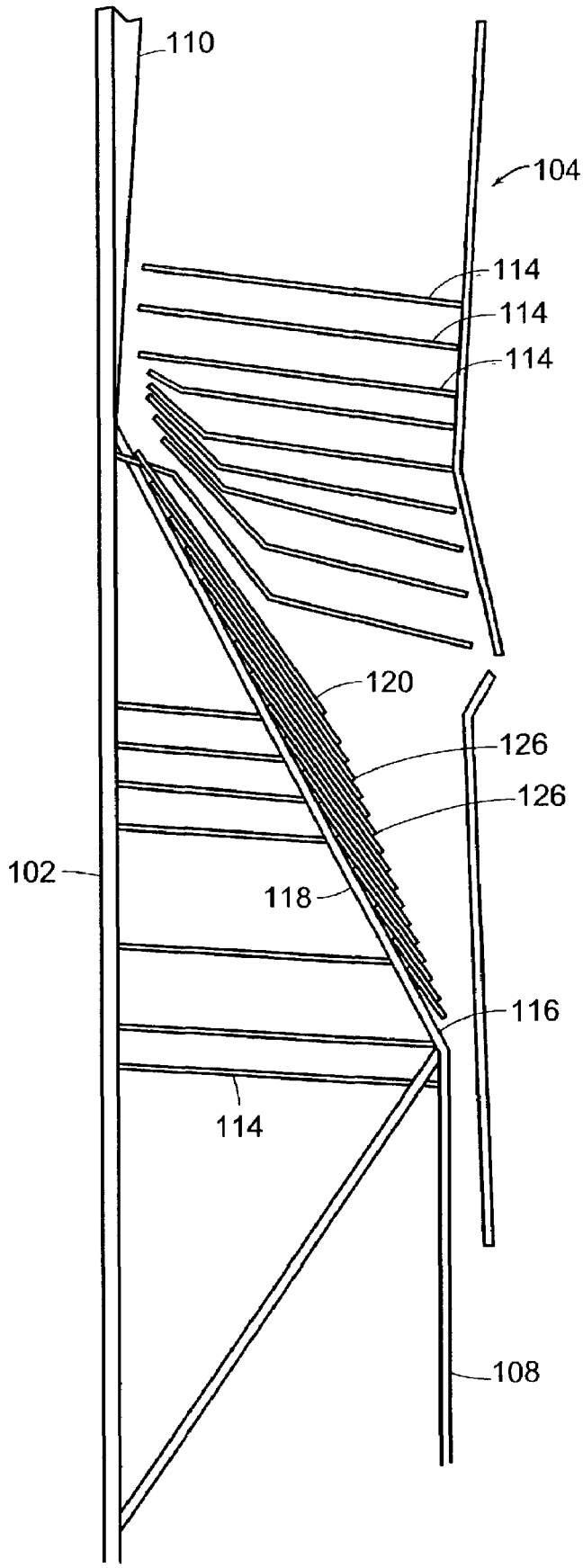
FIG. 9 is the same view as FIG. 6 after a structural failure.

Beyond covering barrier 118, the hinging floor sections 126 drive the broken section of column 108 out from the structure so that it can fall clear as shown in FIG. 9. FIG. 8 shows the linkage that accomplishes that. When floor sections break at point 128 they are then only held by links 130 and the gravity load pulling floor sections 126 down will force them out due to the links 130 and the pivots 132. This drives the floor sections against column 108 breaking it at point 116 and driving it outward.

It is crucial to prevent a situation where, during the collapse, a cascade begins where one floor and all the structure above it falls on another, causing that to fall and then the two floors and all the structure above cause a third to fall and so on causing the falling mass to become very large, dense and unmanageable. This is what happened in the World Trade Center collapse of Sep. 11, 2001. Structural failure of column 108 between point 116 and critical floor 120 will simply start the collapse of the whole structure above the point of failing and the first floor sections 126 that fall will push out column 108 as explained earlier, causing all floor sections 126 to fall, forming the solid barrier. The whole structure above the breaks will begin to fall also causing critical floor 120 to hinge down and in doing so releasing it from column 108 by the action of link 136, pivot 138, and compression pivot 140, FIG. 7, which allows disconnection of link 136 and column 108 when the angle 142, FIG. 7, become acute due to the lowering of column 108 as it begins to fall. The disconnection is facilitated by pivot 140 which is a socket rather than a pin so that link 136 is only held in place when forced into the socket by compression along its length. Joints 144 of other floors sections 126 simply break when over stressed in bending.

Joints between floors 114 and column 108 need not break in any special way. They may remain intact (because columns, too, are falling) until after floors 114 have impacted the barrier, or they may break at impact. Joints between floors 114 and core 102 or wing wall 110 must not only break cleanly but also preferably impart some lateral force to generate clearance between the falling structure and core 102 or wing walls 110. As the outer portion of a floor 114 begins to fall, the upper end of link 148 acts as a fulcrum and thereby stresses joint 146 beyond its design limit. This releases floor 114 to fall, held only by the bracing links 148. The downward force swings links 148 out and pushes floor 114 away from the support. Links 148 disconnect at either end after they pivot and the compression force disappears. This is similar to the action of link 136 and pivot 140 above.

The structure above critical floor 120 then falls as a unit, and one floor at a time impacts the barrier and is forced outward as shown in FIG. 9. Given that each floor can weigh several hundred tons, the impact is still considerable, but the covered barrier can be designed to withstand such an impact repeatedly. Specifically, the supports of barrier 118 are strong enough to carry the weight of all the structure above, but that load is no longer transmitted to it when column 108 breaks. That breakage therefore causes the load on the support portions below point 116 to decrease greatly, by thousands or tens of thousands of tons. Likewise, the load on core 102 has been greatly reduced when floors 114 break away. So the supports of barrier 118 can readily take the impact of one floor at a time as the structure above falls.

There will be a lateral load imposed on the solid barrier due to the lateral deflection of the load. This will be considerable, but the loads imposed on core 102 and the lower part of ray 104 will be well below what they have to be designed for to handle wind and other lateral loads.

Structural failure of column 108 above critical floor 120 would cause a cascading collapse and in turn an unmanageable load on the barrier except for provisions in this structure to prevent it. To prevent cascading and concentration of the mass it is necessary to have the entire structure above critical floor 120 fall as a unit so that one floor at a time hits the barrier. Therefore, no matter where the structural failure occurs above critical floor 120 a break must occur very quickly afterward at critical floor 120 to cause the whole mass above to fall in a unit before a failure within the unit causes a concentration of mass. The primary function of critical floor 120 is to trigger this break and to do so only after a failure has occurred that would other wise collapse the whole ray. It may seem undesirable to trigger a failure thirty or more floors from the top of a building if the structural failure has occurred only five or ten floors from the top. If more barriers were designed into the structure, maybe one of the barriers would be only ten or fifteen floors from the top, and much less damage would occur. Such a design with multiple barriers is within the scope of this invention. It is expected, though, that normally only one barrier would be used; while a single barrier offers a great advantage at reasonable cost, each additional barrier costs as much but can save fewer lives and less structure in the event of a disaster. It is certainly not desirable to shed more floors than necessary, but the alternative is far worse. The advantage of the barrier is great not only for occupants of the building but for the surrounding area, which would be far more seriously impacted by a total collapse of the ray.

Critical floor 120 causes the break by buckling columns 108 in response to loads imposed because of a structural failure anywhere above it. Column 150, which FIGS. 6 and 7 depict, extends upward through the structure more or less parallel to column 108. It passes through each floor and at each floor has a bracket 152 that will allow a floor to apply a downward force on column 150 if the floor moves down relative to column 150. Column 150 at its lower end rests on critical floor 120, FIGS. 6 and 7. Column 150 then becomes an alternative means of support if column 108 fails. But the purpose is not to be able to actually support the load but rather to transmit enough load to critical floor 120 to cause floor 120's connection 154 to column 108 to fail. The load then is transferred to link 136, which imposes an outward load on column 108 at point 156. Column 108 is held at points 144 and 158 by floors 114 thus an outward force at point 156 will cause a fracture in bending at point 156. The weight above immediately causes this to become a buckling failure and the whole structure above critical floor 120 begins to fall as a unit. Critical floor 120 and floor sections 126 below it fold down as column 108 is forced out and the controlled collapse begins.

Ray 104 could fail in a variety of unpredictable ways due to the unpredictable nature of the catastrophe that would cause failure. Therefore columns 150 would be redundant and distributed in ways to minimize their loss of function in an event. Buckling can be triggered not only by floor 120's breaking at point 154 but also by its breakage at joint 122 (FIG. 8) at core 102. Thus loads beyond a set amount anywhere on critical floor 120 will trigger the controlled collapse. If joint 122 breaks, link 124 forces critical floor 120 outward to cause the buckling.

The amount of damage below point 116 that column 108 can sustain without causing a total collapse of ray 104 is greater if the structure above point 116 is shed in response to imminent failure of the whole structure. If ray 109 has one barrier, then point 116 is chosen such that the chance of column failure below point 116 becomes very remote because of their size as dictated by the gravity loads. Above point 116 columns 108 are less massive and more susceptible to impact, explosion, fire, etc. However, even if severe damage occurs below point 116, critical floor 120 can prevent total collapse if the elimination of the weight above point 116 would save the remainder.

Barrier 118, diagonal 112 and floor 160 of FIG. 6 form a rigid truss extending from core 102. If column 108 fails below point 116, this truss can hold some of the weight below point 116 if weight from above is eliminated. Thus if column 108 fails below point 116 and starts to pull away, tension rods 162 will pick up some of the load via connection 164. Joint 166 will fail in tension letting this relative motion occur before enough load is imposed to pull the whole structure down. The shift in load to rods 162, connected at their upper ends to critical floor 120, will cause critical floor 120 to start a controlled collapse above point 116 to quickly reduce the loads on the truss by, in this example, tens of thousand of tons. The remaining columns 108 could then likely carry the load and save the rest of the structure. As with columns 150, rods 162 can be strategically placed to maximize effectiveness. The structure above point 116 would most likely differ greatly from the below point 116. The structure above must be able to collapse with minimal collateral damage. For example, bracing such as diagonals 112 would tie the structure together in a way that might cause difficulties in disconnection from core 102, or they might fall to the side instead of being forced outward. For maximum structural effectiveness as well as ease of shedding the major vertical supports should be the core and the outer wall, furthest away from the core. To tie this wall to the core 102 for added structural integrity, diagonals such as diagonal 168 of FIG. 2 might be used. This would tend to hinge down in a way that gives a lateral impulse to upper section of ray 104 as it falls. It could be primarily a tension member and could fail in compression during collapse.

The outer supporting walls above point 116 might be constructed of numerous small columns instead of a few massive ones as below. This would reduce collateral damage upon failing.

Design details can differ greatly in any particular implementation of these concepts. For example, the barrier can be a solid structure rather than a frame if it does not interfere excessively with the normal building use. Its angle with the horizontal may be different from the illustrated 60 degrees, but it is preferably be quite steep. The angle it forms with the horizontal should be at least 30 degrees. Although the element used by the illustrated embodiment to cause the columns 108 to buckle is one of the floors, i.e., critical floor 120, some other mechanism, such as a dedicated bracket, could be used for this purpose. Also, although the energy for the forced buckling comes from the failure of the structure itself, some motor-driven or other active mechanism could be used for this purpose if enough care were taken. The illustrated approach is highly desirable, though, since it would be less likely to cause the columns to buckle at an undesirable time.

Although I have described the inclined-barrier concept by reference to a building in which part of the inclined barrier's support is provided by a massive, generally conical, reinforced-concrete core, the support and other functions that the illustrated core 102 performs in this regard could be performed in some other way. For example, if two structures similar, for instance to one of the rays were built back to back with enough individual integrity in each so that if one failed the other section would stay, each could perform for the other the functions that the illustrated core performs. However, the illustrated core solves a lot of problems. It contains elevators, utilities, stairs, etc. that then don't have to be in the ray structures. That greatly simplifies the collapse mechanism and gives much more integrity to the core, which need not be weakened by having elevators pass through its walls.

Accidents and terrorism can't be entirely avoided, and large tall buildings represent a lot of lives and investment. This invention can greatly reduce the effects of a major structural failure.

Tall buildings can add greatly to the quality and density of a city. This can represent huge savings in transportation time and energy. The buildings themselves can be very energy efficient if properly designed. For example, little or no heating is required. Large, tall buildings can be multi-use where people can live and work in the same building or one near by. Human contact is enhanced, mass transit is efficient and fast, natural light and good views are readily available. Using the third dimension (height) more effectively makes the whole city more dynamic. To be able to do so with greater security is an important advantage.

What is claimed is:

1. A multi-story building including a plurality of floors, a barrier that has upward- and downward-directed faces, and supports that support the floors and the barrier, the barrier being disposed above some of the floors and below others of the floors and being so constructed and supported that, when a single floor above it falls onto the barrier, the barrier prevents any substantial portion of that floor from falling onto a floor disposed below the barrier, the barrier being inclined downward from an upper end thereof to a lower end thereof at an inclination angle of at least 30° with the horizontal so as to shed from its lower end a floor that has thus fallen onto it, wherein the barrier includes:

A) a barrier frame inclined at the inclination angle and forming at least one passage therethrough; and B) a set of at least one hinged floor extending horizontally from the upward-directed face and so supported and attached to the barrier frame that if the hinged floor is subjected to a predetermined downward failure load that the barrier frame can support, the hinged floor will hinge down and be supported by the barrier frame in such a position that the set of at least one hinged floor substantially covers the at least one passage though the barrier frame.

2. A building as defined in claim 1 wherein one of the supports is a reinforced-concrete tapered tubular core that supports the barrier at the upper end thereof.

3. A building as defined in claim 1 wherein the floors above the barrier are so supported that failure of the uppermost floors of a group thereof disposed above the barrier causes the lowermost floors of that group to fall to the barrier before the uppermost floors can fall on the lowermost floors.

4. A building as defined in claim 1 wherein, when any given floor above the barrier falls, every floor between the given floor and the barrier falls before the given floor can fall on that floor.

5. A multi-story building including a plurality of floors, a barrier that has upward- and downward-directed faces, and supports that support the floors and the barrier, the barrier being disposed above some of the floors and below others of the floors and being so constructed and supported that, when a single floor above it falls onto the barrier, the barrier prevents any substantial portion of that floor from falling onto a floor disposed below the barrier, the barrier being inclined downward from an upper end thereof to a lower end thereof at an inclination angle of at least 30° with the horizontal so as to shed from its lower end a floor that has thus fallen onto it, wherein:

A) a plurality of floors above the barrier will fall if a set of at least one support for that plurality of the floors is so loaded as to buckle outward; and B) the building further includes a side-load mechanism responsive to falling of at least some floors above the barrier to so load the set of at least one support for that plurality of floors as to cause that at least one support to buckle outward and thus the plurality of floors to fall.

6. A building as defined in claim 5 wherein the side-load mechanism includes:

A) a critical floor so mounted as to exert a lateral force and thereby so load the at least one support for the plurality of floors as to cause it to buckle when the critical floor is subjected to a predetermined failure load; and B) a set of at least one a load-transmission column so disposed with respect to the plurality of floors to which the side-load mechanism is responsive as, when such a floor falls, to transmit to the critical floor from the falling floor at least the predetermined failure load.

7. A multi-story building that includes a reinforced-concrete tapered tubular core and a plurality of enclosed floors supported by and substantially surrounding the core, the core being at least 90% closed and forming an interior space that contains at least one elevator.

8. A building as defined in claim 7 wherein, through the majority of its height, the core thickness is at least 2% of its diameter.

9. A building as defined in claim 7 wherein, through the majority of its height, the core forms an angle of between 1° and 10° with the vertical.

10. A building as defined in claim 7 wherein the core is substantially frusto-conical.

11. A building as defined in claim 7 wherein the core is so self-supporting as to enable it to remain standing if the floors surrounding it collapse.

12. A building as defined in claim 7 wherein the building forms a plurality of independent structures that extend from the core, include the enclosed floors, and are so arranged as to permit at least one of the independent structures to remain substantially intact if another of the independent structures collapse.

* * * * *